US005935490A

United States Patent [19]

Archbold et al.

[11] Patent Number: 5,935,490

[45] Date of Patent: Aug. 10, 1999

[54] OXYGEN DISSOLVER FOR PIPELINES OR PIPE OUTLETS

[75] Inventors: Edwin P. Archbold, Craigie; Stephen P. Vaughan, Chatswood, both of Australia

[73] Assignee: BOC Gases Australia Limited, Chatswood, Australia

[21] Appl. No.: 08/899,999

[22] Filed: Jul. 24, 1997

[30] Foreign Application Priority Data

Jul. 26, 1996 [AU] Australia ..... PO1290

[51] Int. Cl.[6] ..... B01F 3/04

[52] U.S. Cl. ..... 261/76

[58] Field of Search ..... 261/76, DIG. 70, 261/DIG. 82

[56] References Cited

U.S. PATENT DOCUMENTS

| | | | |
|---|---|---|---|
| 847,010 | 3/1907 | Koerting | 261/76 |
| 2,301,315 | 11/1942 | Opp | 261/76 |
| 3,524,630 | 8/1970 | Marion | 261/76 |
| 3,855,367 | 12/1974 | Webb . | |
| 4,051,204 | 9/1977 | Muller et al. . | |
| 4,210,613 | 7/1980 | Webb . | |
| 4,689,237 | 8/1987 | Fabre | 261/76 |
| 4,761,077 | 8/1988 | Werner | 261/76 |
| 5,240,650 | 8/1993 | Wiederhold et al. | 261/76 |
| 5,512,217 | 4/1996 | Batterham et al. . | |
| 5,520,856 | 5/1996 | Garrett et al. | 261/76 |

FOREIGN PATENT DOCUMENTS

| | | | |
|---|---|---|---|
| 32764/93 | 6/1993 | Australia . | |
| 0 684 069 | 11/1995 | European Pat. Off. . | |
| 907814 | 3/1946 | France | 261/76 |
| 971536 | 1/1951 | France | 261/76 |
| 2280421 | 2/1976 | France . | |
| 27 36 271 | 2/1979 | Germany . | |
| 224232 | 7/1985 | Germany . | |
| 42 24 911 | 1/1994 | Germany . | |
| 55-152532 | 11/1980 | Japan | 261/76 |
| 468687 | 7/1937 | United Kingdom | 261/76 |
| 1515221 | 6/1978 | United Kingdom . | |
| 1580177 | 11/1980 | United Kingdom . | |
| 2039762 | 8/1989 | United Kingdom . | |

OTHER PUBLICATIONS

Derwent Abstract SU 1736584 A 9Microbiol Prodn Res D4es Con Inst) May 30 1992).

Patent Abstract of Japan JP 6–190255 A 9Tonen Corp Jul. 12, 1994.

*Primary Examiner*—C. Scott Bushey
*Attorney, Agent, or Firm*—Salvatore P. Pace

[57] ABSTRACT

An apparatus for dispersing a gas into a fluid stream. The apparatus has a generally annular body disposed to define an orifice in the fluid stream, a plurality of inwardly depending apertures formed in the body and in fluid communication with a supply of pressurized gas. Each of the apertures defines a localized injection point for dispersion of the pressurized gas into the fluid stream. The orifice includes a restricted throat section adapted to progressively reduce the effective cross-sectional flow area of the fluid downstream of the apertures, such that resultant velocity and pressure differentials enhance dissolution of the gas in the fluid.

17 Claims, 7 Drawing Sheets

OXYGEN DISSOLVER FOR PIPELINES OR PIPE OUTLETS

The present invention relates generally to pipelines and more particularly to an apparatus and method for dissolving gases such as oxygen in pipelines or pipe outlets.

BACKGROUND OF THE INVENTION

In various applications involving chemical process engineering, water treatment, sewerage treatment, mineral separation and the like, it is desirable to dissolve gases such as oxygen, nitrogen, carbon dioxide, sulfur dioxide, air and admixtures thereof into a fluid stream within a pipeline or pipe outlet. Numerous techniques involving injectors and other devices have been developed for this purpose. However, these suffer various disadvantages. For example, most known injectors produce excessively large oxygen bubbles within the fluid stream because of the tendency for the bubbles simply to expand adjacent the injection nozzles. Larger bubbles are not readily dissolved due to the relative decrease in total surface area for a given volume and so diminish the efficiency of the process.

Another disadvantage of known oxygen injection and dissolution devices is that they are prone to rapid wear, particularly in applications involving abrasive slurries or corrosive fluids. This results in excessive downtime and increased expense for maintenance and repair operations. Some known injectors are also prone to clogging and are generally unserviceable without specialized equipment and expertise. In accordance with the present invention, at least some of these disadvantages of the prior art are overcome or substantially ameliorated.

SUMMARY OF THE INVENTION

In accordance with the present invention there is provided an apparatus for dispersing a gas into a fluid stream comprising a generally annular body disposed to define an orifice in the fluid stream, a plurality of inwardly depending apertures formed in the body for fluid communication with a supply of pressurized gas, each of said apertures defining a localized injection point for dispersion of the pressurized gas into the fluid stream, said orifice including a restricted throat section adapted progressively to reduce the effective cross-sectional flow area of the fluid downstream of said apertures, such that the resultant velocity and pressure differentials enhance dissolution of the gas in the fluid.

DETAILED DESCRIPTION OF THE PREFERRED EMBODIMENTS

The gas dispensing apparatus of the present invention preferably includes an annular retainer adapted to be clamped between complementary radial flanges formed on adjacent sections of a fluid conduit such as a pipeline. It is also preferred that the restricted throat section of the orifice is generally frusto-conical in shape, converging to a neck region of minimum diameter, downstream of the gas injection points. The orifice preferably diverges outwardly downstream of the neck region to the original inner diameter of the pipeline, either through a smooth transition section of substantially uniform curvature or a smooth frusto-conical section.

In one embodiment of the subject apparatus, the retainer is formed from stainless steel, whilst the inner surface of the throat section is formed as a replaceable ceramic insert for enhanced wear resistance and ease of replacement or repair. Alternatively, the body including the throat section, neck and transition section may be entirely constructed of a ceramic material. The apertures are preferably defined by an array of radial passages formed in the ceramic insert, and fed from a surrounding annular manifold region formed in the stainless steel retainer. Each of the passages is between about 0.5 and 5 mm and preferably about 1 mm in diameter. The spacing between the bores is preferably between about 4 and 15 mm at the zone of largest effective cross-sectional flow and between about 2 and 10 mm at the zone of smallest effective cross-sectional flow in the throat section.

In another aspect of the present invention, there is provided a method for dispersing a gas into a fluid stream comprising passing said stream through a conduit into an orifice having a restricted throat section which progressively reduces the effective cross-sectional flow area of the fluid from the cross-sectional area of the conduit to the cross-sectional area of a restricted neck portion downstream of said throat section and subsequently allowing said fluid to pass through said neck portion, gas being supplied to the fluid stream in said throat portion upstream of said neck portion by means of a plurality of localized injection points wherein the resultant velocity and pressure differentials upstream and downstream of said neck portion enhance the dissolution of the gas in the fluid.

Figure 5:
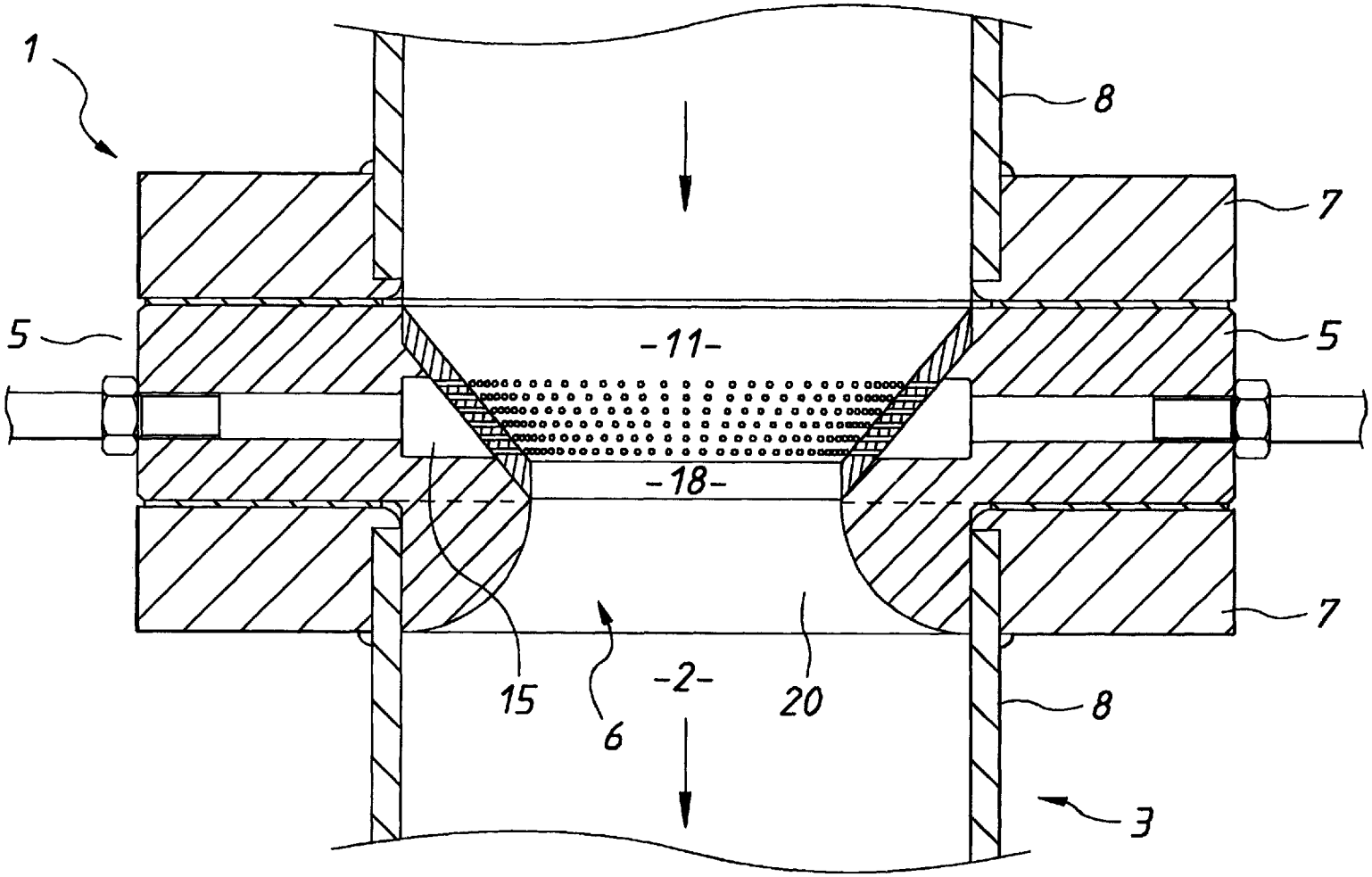
FIG. 5 is a cross-sectional view showing the apparatus of FIGS. 1 to 4, operatively positioned in a fluid pipeline.
Figure 7:
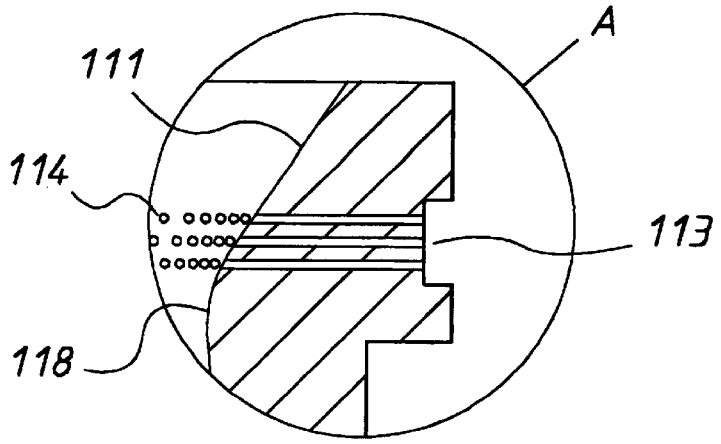
FIG. 7 is an enlarged cross-sectional side elevation of section A namely the throat and neck portion of the ceramic body of FIG. 6.
Figure 6:
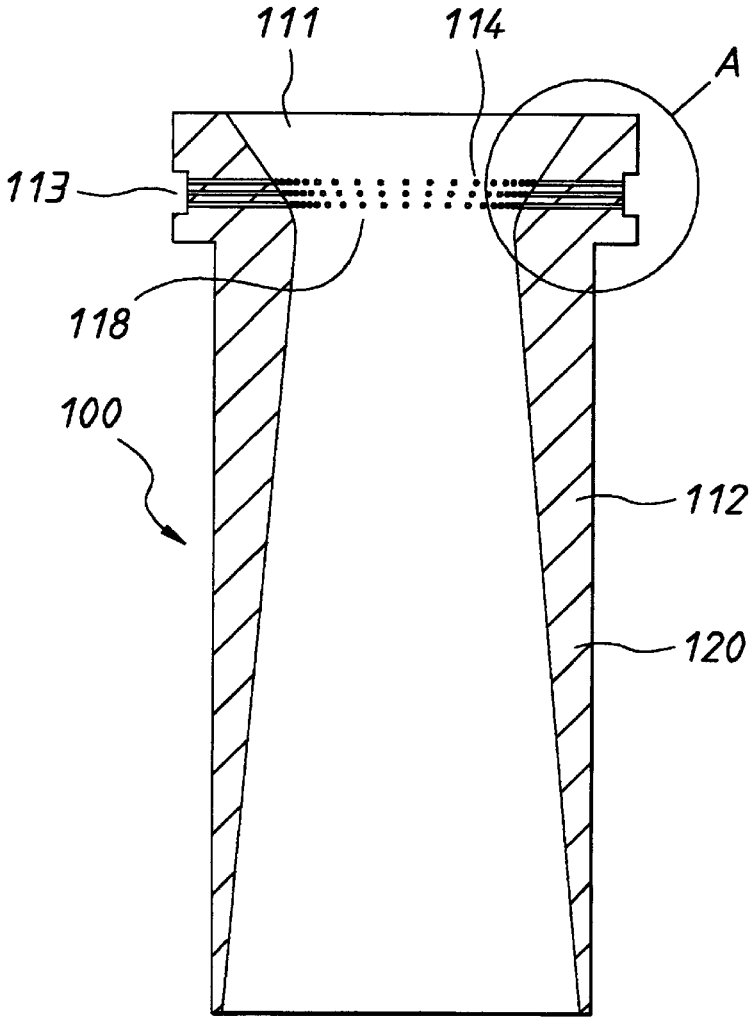
FIG. 6 is a cross-sectional side elevation of a gas dispersing apparatus according to a second embodiment of the present invention.
Figure 9:
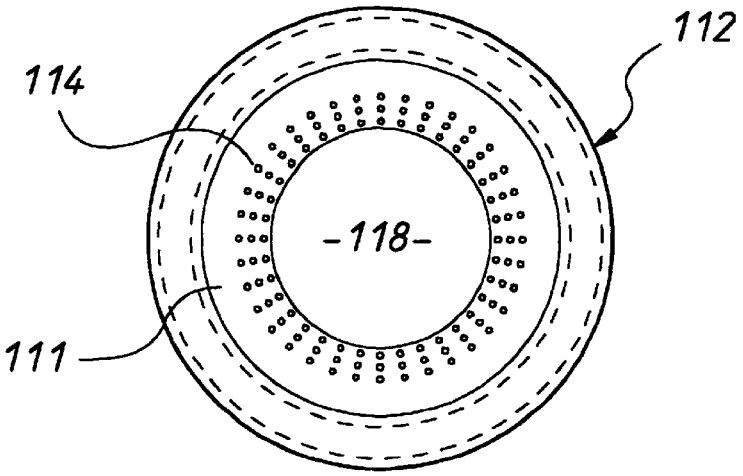
FIG. 9 is a plan view showing the throat section of the ceramic body of the apparatus of FIG. 8.
Figure 8:
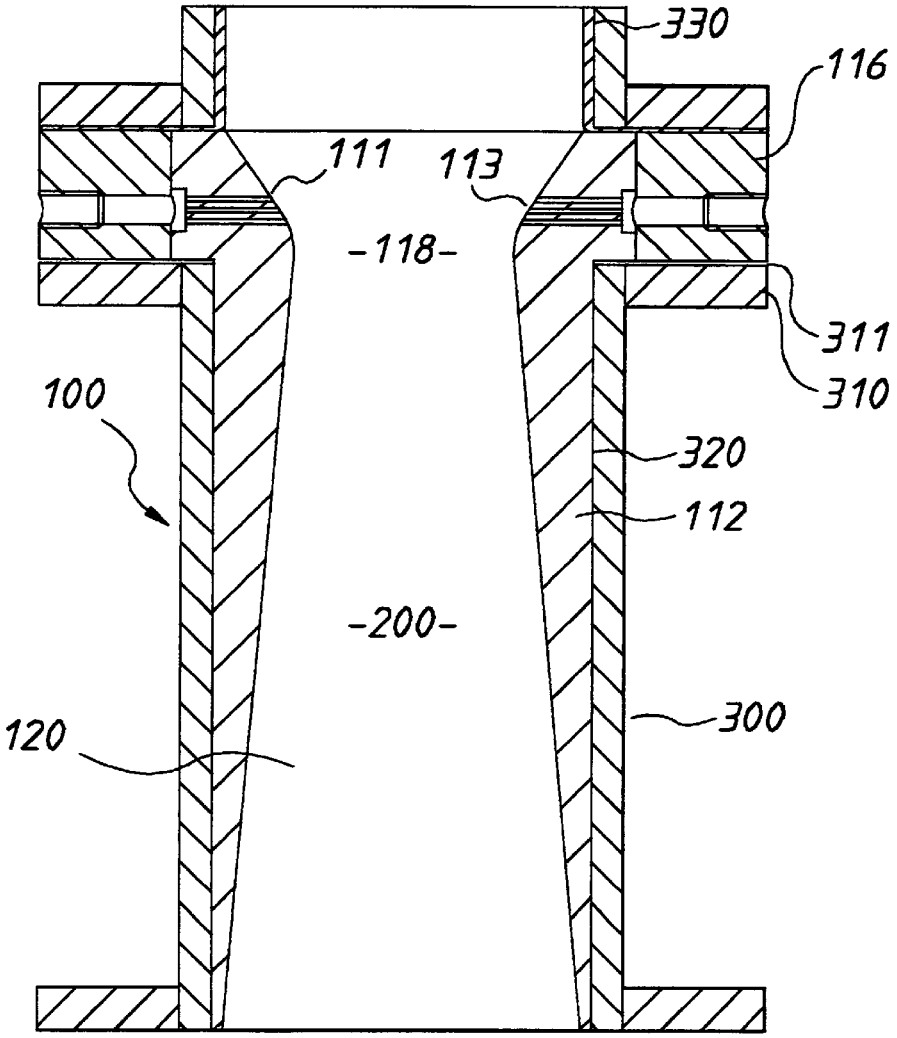
FIG. 8 is a cross-sectional side elevation of a gas dispersing apparatus of FIG. 6 operatively positioned in a pipeline.

Referring to the drawings, wherein corresponding features are denoted by corresponding reference numerals, there is provided in accordance with the present invention an apparatus 1 for dissolving a gas, such as oxygen, into a fluid stream 2 within a conduit such as a pipeline 3. The apparatus comprises a main body in the form of a generally annular stainless steel retainer 5 defining a restricted orifice 6 in the fluid stream. As best seen in FIG. 5, the retainer 5 is adapted to be clamped between complementary radial flanges 7 formed on adjacent sections 8 of the pipeline 3.

Figure 1:
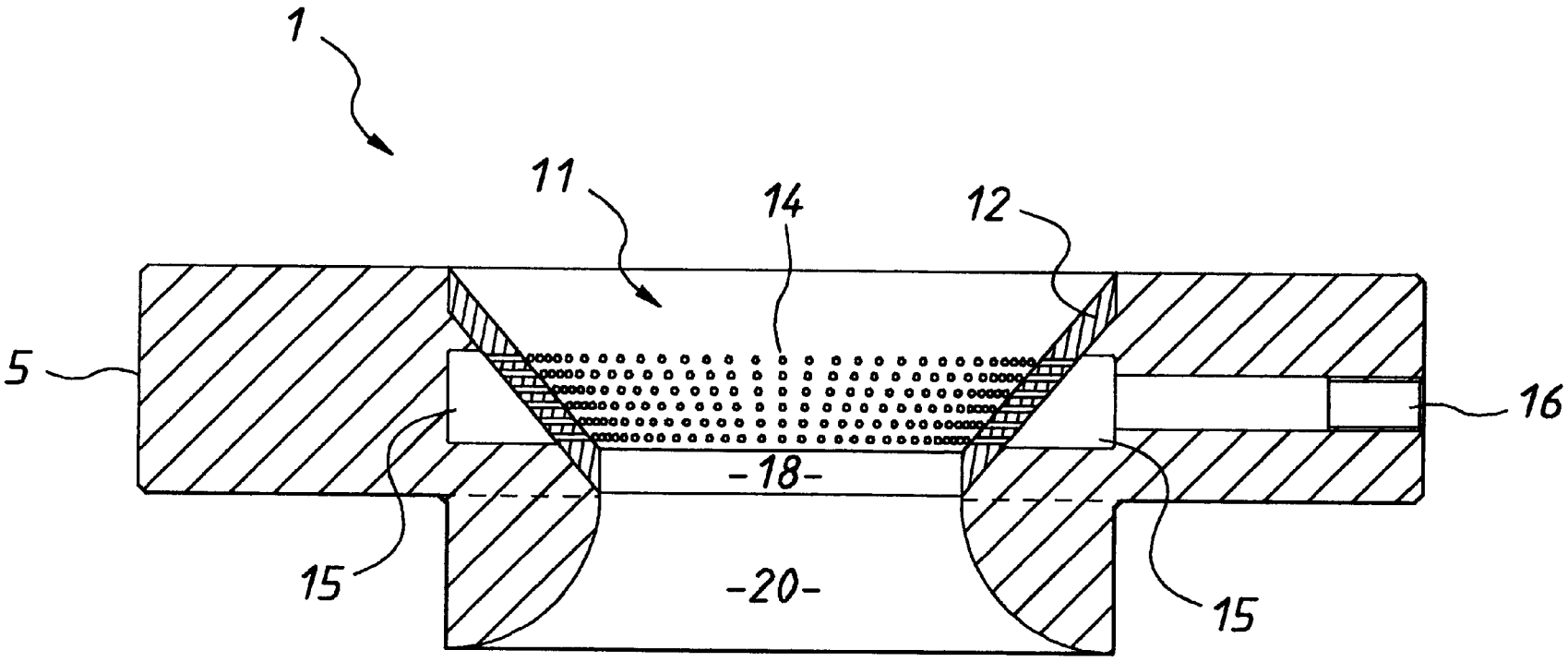
FIG. 1 is a cross-sectional side elevation of a gas dispersing apparatus according to a first embodiment of the present invention.
Figure 2:
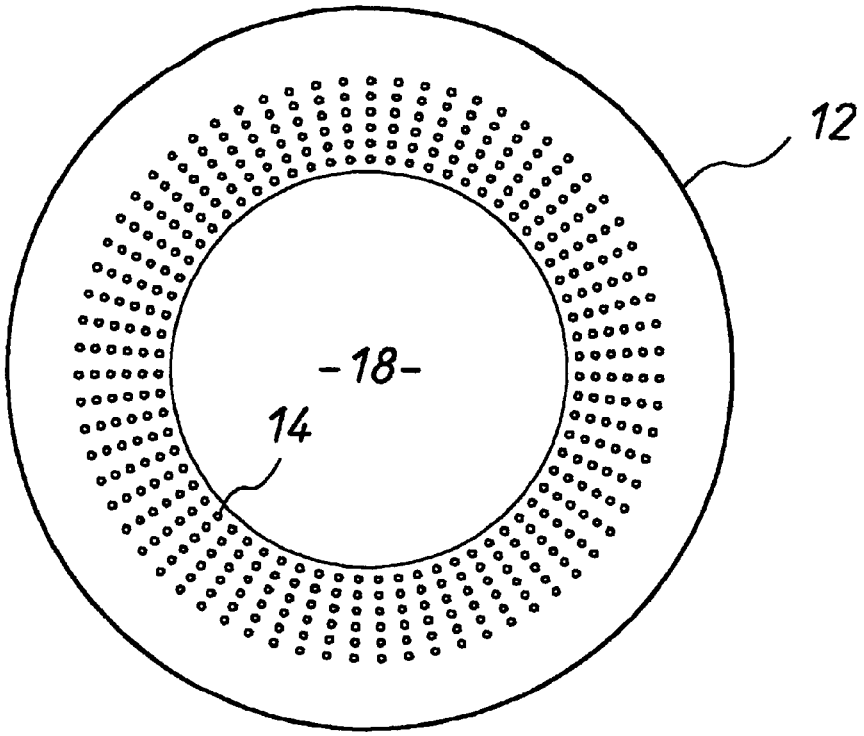
FIG. 2 is a plan view of the ceramic insert which defines the throat section of the apparatus of FIG. 1.
Figure 3:
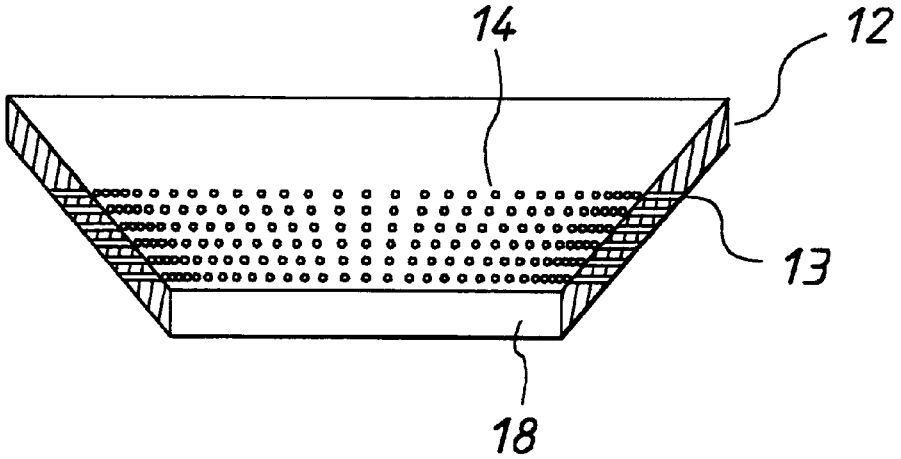
FIG. 3 is a cross-sectional side elevation of the ceramic insert of FIG. 2.
Figure 4:
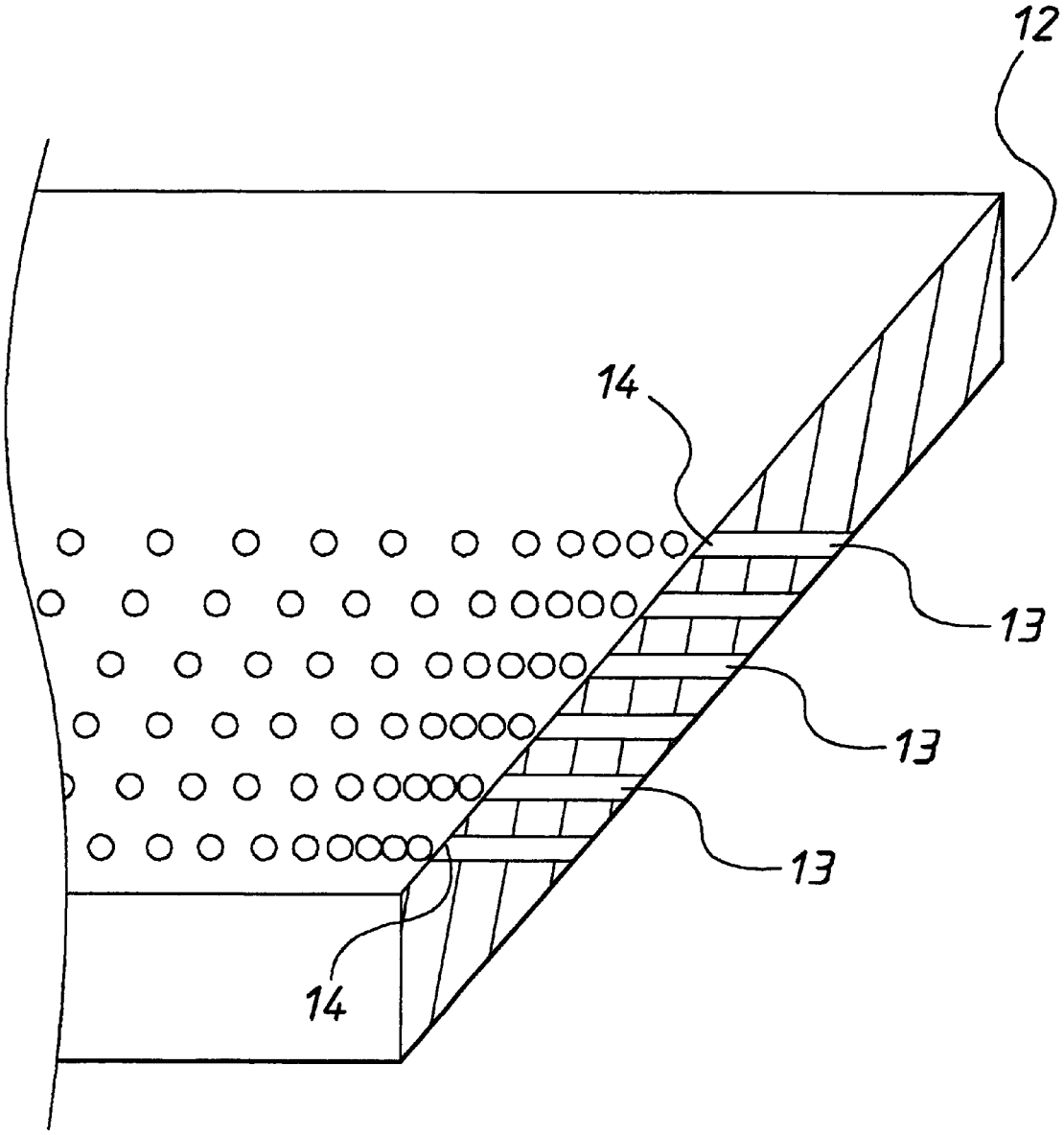
FIG. 4 is an enlarged cross-sectional side elevation of the ceramic insert of FIGS. 2 and 3.

The orifice 6 is defined in part by a generally frusto-conical throat section 11, formed by a replaceable ceramic insert 12. The ceramic insert 12, as seen in FIG. 3, includes a series of radial passages 13 defining a corresponding series of inwardly depending apertures 14. These passages are fed from a surrounding annular manifold region 15 formed in the retainer 5. The manifold region 15, in turn, is in fluid communication with a supply of pressurized gas, via inlet port 16 and appropriate pressurized supply lines, not shown. In this way, each aperture 14 defines a localized injection point for dispersion of the pressurized gas into the fluid stream 2 within the throat section 11 of the orifice 6.

The converging configuration of the throat section 11 is adapted to progressively reduce the effective cross-sectional flow area of the fluid passage toward an intermediate restricted neck region 18 of minimum diameter, downstream of the injection points. Thereafter, the orifice 6 diverges outwardly from the neck region 18 through a downstream transition section 20 to the original inner diameter of the pipeline 3. The transition section 20 is generally frusto-toroidal or bell-mouthed in shape and as such defines a substantially uniform curvature between the neck region 18 of the orifice and the downstream section of the pipeline 3.

In the preferred embodiment, each of the passages 13 formed in the ceramic insert 12 is approximately 1 mm in diameter. The frusto-conical array of apertures is formed in 67 columns and 6 rows, giving an approximate injector spacing of about 5.5 mm at the largest diameter, and about 4.0 mm at the smallest diameter of the throat. The outer diameter of the throat section 11 is preferably about 155 mm, converging to about 85 mm at the neck region 18. It will be appreciated, however, that the apparatus may be produced in any size appropriate to the pipeline in which it is to be used.

The invention enables a high quantity of small gas bubbles to be introduced into the fluid stream 2 upstream of the restricted orifice 6. Through the restricted orifice 6, the fluid velocity increases and in accordance with the Bernoulli relationship, there is a corresponding pressure drop. This allows the small gas bubbles to expand and shear the fluid in a zone of turbulence created within the transition section 20 and downstream of the apparatus 1. This mechanism has been found to significantly enhance the rate at which gas is dissolved in the fluid stream 2. Furthermore, because the gas apertures 14 are disposed directly in the fluid path, the gas bubbles are stripped from the injection points immediately upon creation, thereby preventing the formation of excessively large bubbles. The resultant creation of a larger number of relatively small bubbles maximizes the total surface area of the gas-liquid interface and thereby further enhances the rate at which the gas is dissolved.

Additionally, the disposition of the gas apertures 14 on the upstream face of the restricting orifice 6 provides a gas cushion against the slurry flow which acts to reduce component wear. This upstream zone is also a region of relatively high pressure, which favors gas dissolution. It will further be appreciated by those skilled in the art that the apparatus of the invention makes use of positive gas supply pressure rather than inducing gas flow at atmospheric pressure. This arrangement thus makes use of the energy of compression, already inherent in various sources of compressed industrial gas, to increase the rate of gas dissolution. By providing axial as distinct from centrifugal flow, the apparatus and method of the present invention act to reduce the number and relative size of high wear points which leads in turn to longer component life. In preferred applications, the subject apparatus is not completely submerged in the process fluids which is advantageous in that it permits easier access for inspection and maintenance. Furthermore, this arrangement simplifies the selection of materials and surface preparations for the external body of the apparatus. Finally, the use of a high wear resistant material such as ceramic for the restricting orifice provides the benefit of allowing relatively complex shapes to be manufactured with a relatively long wear life, compared for example with machined metals.

Referring now the second embodiment shown in FIGS. 6–9, in this embodiment the apparatus 100 is positioned in a pipeline 300 for dissolving a gas, such as oxygen, in a fluid stream 200 passing through the pipeline 300. The apparatus 100 comprises a main replaceable ceramic body 112 which defines a frusto-conical throat section 111, a transition section 120 which is also generally frusto-conical in shape and a restricted neck region 118 therebetween. The ceramic body 112 includes a series of radial passages 113 defining a corresponding series of inwardly depending apertures 114. The passages 114 are fed from a surrounding annular retainer ring 116 and appropriate pressurized gas supply lines, not shown. In this way, as with the embodiment shown in FIGS. 1–5, each aperture 114 defines a localized injection point for dispersion of the pressurized gas into the fluid stream 200 within the throat section 111 and upstream of the neck region 118.

The embodiment shown in FIGS. 6–9 differs from the embodiment of FIGS. 1–5 in that the ceramic body 112 includes both the upstream frusto-conical throat section 111 and downstream transition section 120. It is also preferred that the downstream transition section 120 is extended further down the pipeline 300 to provide a more gradual divergence from the effective cross-sectional flow area of neck region 118 to the effective cross-sectional flow area of the pipeline 300. In this way, the transition section 120 defines a smooth gradual expansion thereby reducing cavitation and turbulence downstream of the neck region 118.

As will be understood by persons skilled in the art, the long tapered walls of transition section 120 also serve to provide support for throat section 111. To explain, there is considerable force applied by fluid stream 200 to the throat section 111. The applicants have found that the ceramic throat section 111 may fail as a result if it is not provided with sufficient support. Not only does transition section 120 provide a smoother divergent section for the fluid stream 200 and dissolved gas, thereby reducing turbulence, it also serves to provide a more reliable support for throat section 111.

In the embodiment shown in FIGS. 1–5, 6 rows and 67 columns of apertures are provided in the throat section 111. In the embodiment shown in FIGS. 6–10, 3 rows with 36 columns are provided with an approximate injector spacing with about 10 mm at the largest diameter and about 8 mm at the smallest diameter of throat section 111. Each of the passages 113 formed in the ceramic body 112 is approximately 1 mm in diameter. The outer diameter of the throat section 111 is preferably about 140 mm converging to about 85 mm at the neck region 118. The transition section 120 is approximately 300 mm long and the throat section 111 approximately 50 mm long. Once again, however, as discussed in regard to the embodiment of FIGS. 1–5, the apparatus may be produced in any size appropriate to the pipeline in which it is used.

The ceramic body 112 may be attached to the pipeline 300 by any appropriate mechanism, for example by glue or other similar substance 320. The pipeline flange 310 serves to position the apparatus 100 in the pipeline 300. An appropriate gasket 311 is preferably positioned between the flange 310 and the retainer ring 116.

If desired, to further reduce wear on the interior wall of pipeline 300, a wear-resistant lining 330 may be included as well. This lining, which may be produced from rubber for example, is particularly useful where the fluid stream is highly erosive and corrosive.

Figure 10:
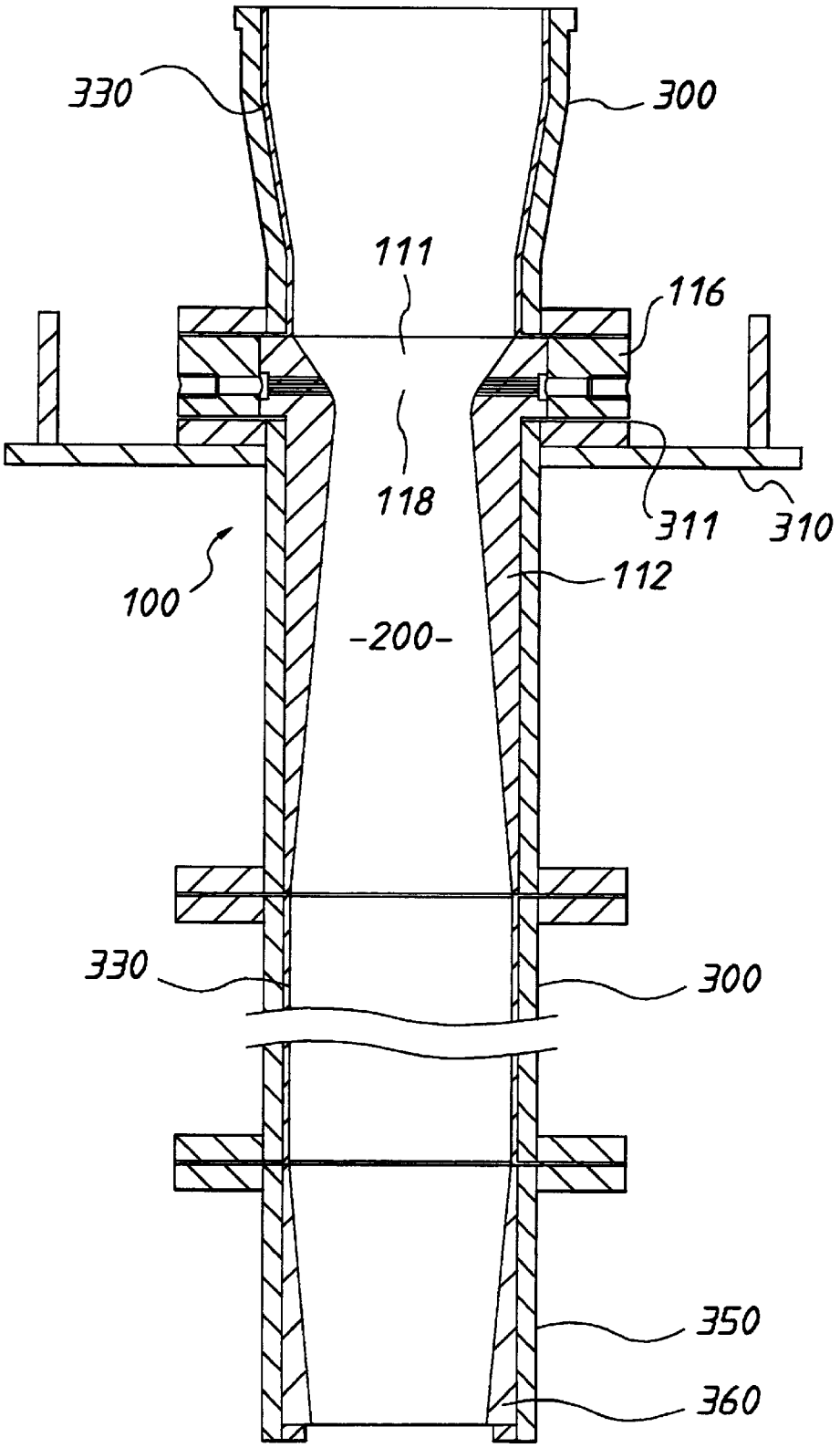
FIG. 10 is a cross-sectional view showing the apparatus of FIGS. 6 to 9 operatively positioned in a fluid pipe discharge into a tank.

As discussed above, the present invention is particularly suitable for use within a pipeline, but may also be used with a pipeline discharge. FIG. 10 shows inventive apparatus 100 installed adjacent a pipe discharge 350. This discharge 350 may, for example, feed the fluid stream 200 after it has been dosed with the appropriate quantity of gas into an open tank (not shown). The pressure drop in the fluid stream 200 between the inventive apparatus 100 and the tank, which would be at atmospheric pressure, will cause the gas to come out of solution in the form of fine bubbles thereby increasing the agitation and mixing in the tank as well as increasing the surface contact area between the gas and the fluid.

Preferably, the pipe discharge 350 includes a flow constriction means 360. In the embodiment shown in FIG. 10, the flow constriction means 360 is provided by another restricted throat section which reduces the effective cross-sectional flow area at the pipe discharge 350. This constriction means serves two purposes. Firstly, by reducing the effective cross-sectional flow area, it maintains the fluid/gaseous mixture at an elevated pressure in the pipeline 300 such that, once the mixture leaves the pipeline discharge 350, the pressure is substantially reduced and the gas comes out of solution.

The applicants have found, however, that the flow constriction means 360 also serves to reduce vibration of the pipe discharge 350. To explain, the section of pipe 300 downstream of the inventive apparatus 100 tends to vibrate or oscillate in response to the speed and pressure of the fluid 200 flowing therethrough. The applicants have found that, by providing a flow constriction means at the pipe discharge 350, the pipeline 300 does not vibrate to such a great extent. The constriction means 360 may be the simple throat section shown in FIG. 10 or alternatively a valve arrangement for controlling flow of the fluid through the pipe discharge 350.

As mentioned above, the embodiment shown in FIG. 10 may be used to feed a fluid, such as a slurry, to a tank. Generally, such tanks contain an impeller and in a particularly preferred embodiment the pump discharge 350 is positioned at approximately 70% of the radius of the tank impeller to thereby take advantage of the maximum downdraft from the impeller.

The applicants have noted a substantial increase in the dissolved gas content of the fluid in the tank using the fluid discharge configuration shown in FIG. 10. For example, using the inventive apparatus for dissolving oxygen in an ore slurry, 0.05–0.1 $m^3$ of oxygen per ton of ore is consumed to achieve a dissolved oxygen level of 20 ppm. This can be compared with previous consumption using conventional lances, normally in the form of 4×2 mm nozzles, which use 0.3 $m^3$ of oxygen per ton of ore to achieve a dissolved oxygen content of 19 ppm.

Other advantages of the invention include a cheaper capital cost as compared with prior art devices, reduced wear, less maintenance, easier serviceability, more efficient mixing, and a greater resistance to blockages. Moreover, the invention is adaptable to a wide range of applications including mineral extraction, water treatment, sewerage treatment, slurry pumping and the like. Accordingly, the invention represents a commercially significant improvement over the prior art.

Although the invention has been described with reference to specific examples, it will be appreciated by those skilled in the art that the invention may be embodied in many other forms without departing from the spirit thereof.

We claim:

1. An apparatus for dispersing a gas into a fluid stream flowing through a conduit comprising a generally annular body disposed to define an orifice in the fluid stream, said orifice including a restricted throat section adapted to progressively reduce the effective cross-sectional flow area of the fluid from the cross-sectional area of the conduit to the cross-sectional area of a neck portion downstream of said throat section, and a plurality of inwardly depending apertures formed in said throat section in fluid communication with a supply of pressurised gas, each of said apertures defining a localised injection point for dispersion of the pressurised gas into the fluid stream upstream of said neck portion, whereby the resultant velocity and pressure differentials in the fluid upstream and downstream of said neck portion enhance dissolution of the gas therein.

2. An apparatus in accordance with claim 1 including an annular retainer adapted for clamping between complementary radial flanges formed on adjacent sections of the wall of said conduit.

3. An apparatus in accordance with claim 1, wherein the restricted throat section of the orifice is generally frusto-conical in shape and converges to a neck region of minimum effective cross-sectional flow downstream of the gas injection points.

4. An apparatus in accordance with claim 3 wherein the orifice diverges outwardly downstream of the neck region to an original inner diameter of said conduit through a generally smooth transition section of substantially uniform curvature in cross-sectional profile.

5. An apparatus in accordance with claim 3, wherein the orifice diverges outwardly downstream of the neck region to the original inner diameter of said conduit through a generally smooth frusto-conical transition section.

6. An apparatus in accordance with claim 1, wherein the inner surface of the throat section is a replaceable wear resistant insert.

7. An apparatus in accordance with claim 4, wherein the throat section, neck and transition section are all formed from a ceramic material.

8. An apparatus in accordance with claim 1, wherein said apertures are defined by an array of radial passages formed in the throat section.

9. An apparatus in accordance with claim 8 wherein each of said passages is between about 0.5 mm and 5 mm in diameter.

10. An apparatus in accordance with claim 9, wherein each of said passages is about 1 mm in diameter.

11. An apparatus in accordance with claim 8, wherein the spacing between the radial passages is between about 4 and 15 mm at the zone of largest effective cross-sectional flow in the throat section and between about 2 and 10 mm at the zone of smallest effective cross-sectional flow in the throat section.

12. A method for dispersing a gas into a fluid stream comprising passing said stream through a conduit into an orifice having a restricted throat section which progressively reduces the effective cross-sectional flow area of the fluid from the cross-sectional area of the conduit to the cross-sectional area of a restricted neck portion downstream of said throat section and subsequently allowing said fluid to pass through said neck portion, gas being injected from a pressurised source into the fluid stream in said throat section upstream of said neck portion by means of a plurality of localised injection points whereby the resultant velocity and pressure upstream and downstream of said neck portion enhance the dissolution of the gas in the fluid.

13. A method in accordance with claim 12, wherein directly downstream of said neck portion, said fluid stream is passed through a divergent portion which diverges outwardly to increase the effective cross-sectional flow area of the fluid from the cross-sectional area of the neck portion to the original cross-sectional area of said conduit.

14. A method in accordance with claim 12, wherein gas is supplied to said localized injection points under pressure.

15. A method in accordance with claim 13, wherein said fluid is passed through a flow restriction means downstream of the neck portion to maintain the elevated pressure of the fluid resulting from its passage through the neck portion, thereby retaining said gas in solution.

16. The apparatus according to claim 1 in which the plurality of apertures is a frusto-conical array.

17. The method according to claim 12 in which the plurality of localised injection points is a frusto-conical array.

* * * * *